US006640518B2

(12) United States Patent
Bol

(10) Patent No.: US 6,640,518 B2
(45) Date of Patent: Nov. 4, 2003

(54) METHOD OF BALLASTING ROOF COVERING LAYERS ON SUBSTANTIALLY FLAT ROOF SURFACES

(76) Inventor: Frederikus Gerardus Maria Bol, Bergweg Noord 115, 2661 CN Bergschenhoek (NL)

( * ) Notice: Subject to any disclaimer, the term of this patent is extended or adjusted under 35 U.S.C. 154(b) by 82 days.

(21) Appl. No.: 09/804,525

(22) Filed: Mar. 12, 2001

(65) Prior Publication Data

US 2001/0022059 A1 Sep. 20, 2001

(30) Foreign Application Priority Data

Mar. 15, 2000 (NL) ..... 1014654

(51) Int. Cl.[7] ..... E04B 2/82

(52) U.S. Cl. ..... 52/741.41; 52/746.11; 52/748.11

(58) Field of Search ..... 52/408, 411, 537, 52/538, 540, 536, 588.1, 746.11, 748.11, 748.1, 409, 410, 741.4

(56) References Cited

U.S. PATENT DOCUMENTS

| | | | | | |
|---|---|---|---|---|---|
| 3,094,447 | A | * | 6/1963 | Chamberlain | |
| 3,694,306 | A | * | 9/1972 | Fricklas | |
| 3,732,791 | A | * | 5/1973 | Hohwiller et al. | 404/31 |
| 3,763,605 | A | * | 10/1973 | Freeman | 52/58 |
| 4,120,131 | A | * | 10/1978 | Carroll | 52/338 |
| 4,235,058 | A | * | 11/1980 | Patry | 52/408 |
| 4,274,239 | A | * | 6/1981 | Carroll | 52/443 |
| 4,651,490 | A | * | 3/1987 | Marston | 52/410 |
| 4,662,941 | A | * | 5/1987 | Hagerman | 106/89 |
| 4,736,561 | A | * | 4/1988 | Lehr et al. | 52/410 |
| 5,317,852 | A | * | 6/1994 | Howland | 52/408 |
| 5,784,845 | A | * | 7/1998 | Imeokparia et al. | 52/408 |
| 5,784,846 | A | * | 7/1998 | Godschalx | 52/409 |
| 5,950,383 | A | * | 9/1999 | Williamson et al. | 52/408 |
| 6,248,812 | B1 | * | 6/2001 | Symons | 524/2 |

FOREIGN PATENT DOCUMENTS

NL 190274 2/1993

OTHER PUBLICATIONS

Chemical Abstracts, vol. 97, 1982, p. 314, Abstract No. 97.

* cited by examiner

*Primary Examiner*—Carl D. Friedman
*Assistant Examiner*—Yvonne M. Horton
(74) *Attorney, Agent, or Firm*—Hoffmann & Baron, LLP

(57) ABSTRACT

A mortar of a granulated mineral wool, a hydraulic binder and water is placed on a roof to prevent roof covering layer(s) of a substantially flat roof from being blown up in stormy conditions. The roof surface to be ballasted is divided into panels by placing joint elements thereon. The mineral wool component includes rockwool waste originating from horticulture and glass fibre wool waste.

5 Claims, 1 Drawing Sheet

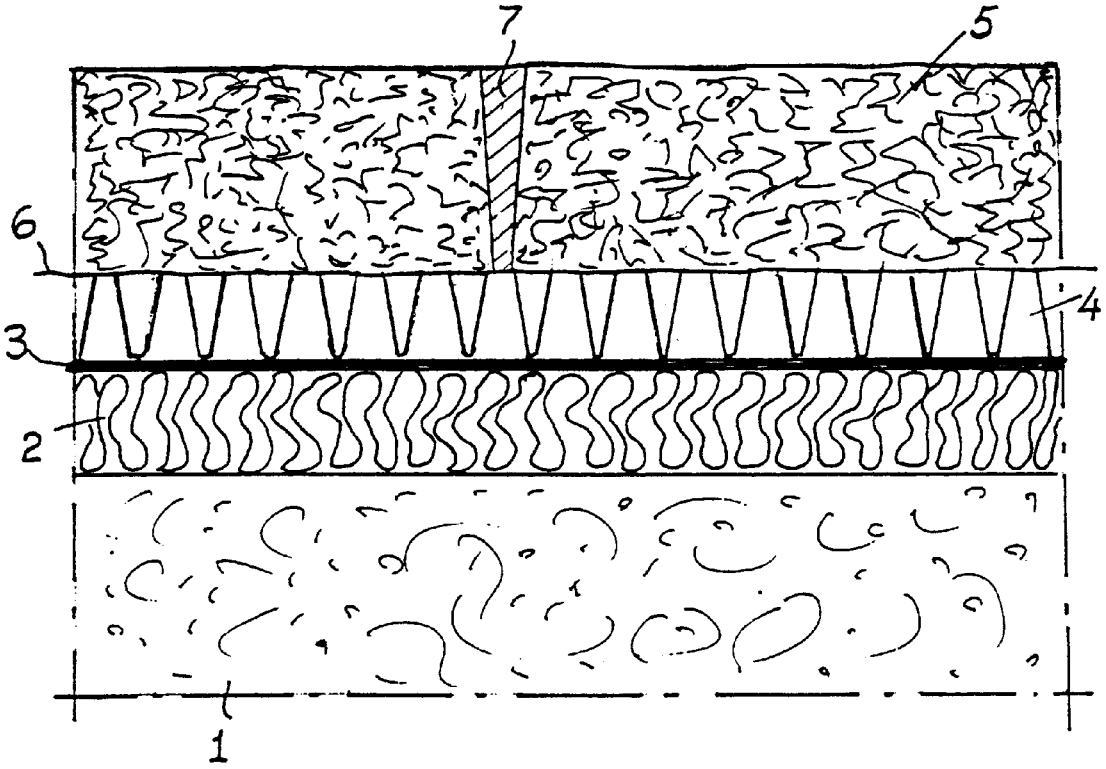
7
5
6
4
3
2
1

METHOD OF BALLASTING ROOF COVERING LAYERS ON SUBSTANTIALLY FLAT ROOF SURFACES

TECHNICAL FIELD

The present invention is in the field of roofing and more particularly relates to a method of ballasting roof covering layers on substantially flat roof bodies. The purpose of ballasting roof covering layers on substantially flat roofs is to secure the required wind-steadiness of such roofs or, in other words, to prevent the roof covering layers on such roofs from being lifted from the basic roof bodies in stormy weather.

BACKGROUND ART

Up to now ballasting of the roof covering layers on flat roof surfaces is effected by applying thereon a layer of ballasting material in the form of gravel or (concrete) tiles.

Applying gravel has the disadvantage that in stormy weather the gravel may be caused to "roll", which may lead to a dangerous situation when gravel particles get off the roof. Moreover, working with gravel is rather labour-intensive, whilst the cleaning of a ballast layer composed of gravel constitutes an expensive factor in roof maintenance. Furthermore, gravel has become a scarce raw material.

The disadvantages mentioned hereinabove are particularly overcome by using concrete tiles (slabs) as a ballasting material. Concrete tiles, however, are relatively expensive and result in a relatively heavy roof load.

SUMMARY OF THE INVENTION

A primary object of the present invention is to provide an improved method of ballasting the roof covering layer(s) on a substantially flat roof body.

According to the present invention a mortar is applied to function as a ballasting material, said mortar being mainly composed of a mineral wool, a hydraulic binder and water.

In a composition of e.g. three parts of granulated mineral wool, one part of binder and one part of water such a mortar can be readily pumped and poured out over the roof covering layer(s) to be ballasted. Upon being poured out and straightened out the mortar sets and forms a slab with a porous or spongy structure, which has excellent drain quality and prevents puddle forming. The ballast layer obtained can be readily treaded as early as twenty four hours after pouring.

A ballast slab obtained by applying the method of the present invention results in a substantially reduction (viz. more than 50%) of the roof load as compared with a roof that is ballasted with concrete tiles of a comparable thickness (e.g. 5–7 cm).

In practice the mineral wool required is available in large amounts in the form of rockwool, that has been used in the substrate growing technique in horticulture.

Accordingly, with the method of the present invention advantageously and preferably use is made of granulated rockwool waste from the horticulture. In that case the method of the present invention not only results in a substantial improvement as compared with the well-known ballasting methods, but also provides a solution for the environmental problem connected with the production of rockwool waste.

The mineral wool mass may partly consist of glass fibre wool, large amounts of which become also available in the form of waste.

A practical mode of the method of the present invention is characterized in that joint strips or joint profiles are placed on the roof surface to be ballasted so as to divide the roof surface into panels, which are subsequently filled with mortar. In this way individual ballast panels or slabs (with a superficial area of e.g. 2–5 $m^2$ may be obtained, which are separated from one another through joints. This avoids the forming of cracks and crevices in the ballast mass.

The joint strips or joint profiles respectively may also be used to function as a support guide for a smoothing instrument, which makes it easy to obtain a uniform ballast layer.

The joint strips may be of a permanent nature, if desired and may be in the form of a gutter profile to further improve the discharge of rain water.

Hereinabove mention has been made of the excellent drain quality and the inherent water water exorbing capacity of the ballast layer obtained with the method of the present invention. In order to achieve a quick discharge of the rain water collected in the ballast layer and thereby achieve a quick drying of the ballast layer, the roof surface to be ballasted may, according to a further feature of the invention, be provided—in advance—with an intermediate layer of a coarse open cellular structure. To realize such an intermediate layer use can e.g. be made of the kind of auxiliary material that is used in the horticulture in the initial germination phase of e.g. young tomato plants, which material is produced by shaping plastic sheet material through vacuum moulding into a plurality of closely adjoining, conically shaped miniature plant pots. Such an intermediate layer, that may have a thickness (height) of 1–2 cm, effects an immediate transfer of the rain water from the proper ballast layer towards the rain water outlet of the roof.

Artificial grass, in fact a perforate sheet of plastic with stud-shaped poles projecting from one side thereof, could be used instead. Such an intermediate layer of artificial grass could be applied with the poles directed to the roof surface to be ballasted.

Further features of the invention will be hereinafter further explained by way of example with reference to the accompanying drawing.

BRIEF DESCRIPTION OF THE DRAWING

The drawing is a cross-sectional view through a part of a substantially flat roof that is ballasted by applying the method of the present invention.

DESCRIPTION OF THE PREFERRED EMBODIMENT

With reference to the drawing 1 is a roof, e.g. a roof slab of concrete, on which an insulating layer 2 is provided, which in turn is covered with the roof covering layer(s) indicated at 3.

To ballast the roof covering 3 an intermediate layer 4 is provided thereon as an initial step. The intermediate layer 4 is of a very open structure, so that it can quickly collect, distribute and discharge the fallen rain water through a drainage pipe (not shown in the drawing). In the example shown the above mentioned "miniature plant pot material" placed as an intermediate layer 4 on top of the roof covering layer(s) 3. The closely adjoining miniature plant pots and the tapered form thereof are clearly shown in the drawing. As a next step the intermediate layer 4 is coated with a film or membrane 6 which is pervious to water. Joint strips 7 placed on the film or membrane 6 divide the surface to be ballasted into a number of panels, which are subsequently filled by pouring the ballast mortar.

The thickness of the ballast layer 5 may be 5–8 cm, which thickness is in the same order of magnitude as the thickness of the well-known ballast layer composed of (concrete) tiles.

As mentioned hereinabove, the joint strips 7 may be left in the ballast mass, if desired, and may be designed as (narrow) gutter elements.

Upon setting the mortar used with the present invention may be suitably coloured, if desired, e.g. by spraying a suitable paint thereon. Moreover, when dividing the surface of the ballast layer into panels, beautiful colour patterns may be obtained.

What is claimed is:

1. A method of ballasting roof covering layer(s) on a substantially flat roof, comprising the steps of placing joint strips or joint profiles on the roof surface to be ballasted, which divide said surface into panels; and applying a layer of ballasting material on the roof covering layer(s), wherein said ballasting material is formed by a mortar, which is mainly composed of a granulated mineral wool, a hydraulic binder and water, said mortar being allowed to set after being applied on the surface to be ballasted.

2. A method according to claim 1, wherein said mortar is prepared in a flowable composition of about three parts of granulated mineral wool, about one part of binder and about one part of water, said mortar being applied by pouring it over the surface to be ballasted.

3. A method according to claim 1, wherein the mineral wool is mainly formed by rockwool waste from the horticulture.

4. A method according to claim 1, comprising the preliminary step of providing the surface to be ballasted with an intermediate layer of a coarse open cellular structure, before applying said mortar thereon.

5. A method according to claim 4, wherein said intermediate layer is covered with a film or membrane that is pervious to water.

* * * * *